United States Patent [19]

Humphreys

[11] 3,977,370

[45] Aug. 31, 1976

[54] ROLLER TAPPET

[75] Inventor: James W. Humphreys, Muskegon, Mich.

[73] Assignee: Sealed Power Corporation, Muskegon, Mich.

[22] Filed: Oct. 23, 1974

[21] Appl. No.: 517,042

[52] U.S. Cl. ..... 123/90.5; 74/569; 123/90.48; 123/90.51

[51] Int. Cl.[2] ..... F01L 1/14

[58] Field of Search ..... 123/90.5, 90.51, 90.2, 123/90.48; 74/569

[56] References Cited

UNITED STATES PATENTS

| | | | |
|---|---|---|---|
| 2,346,737 | 4/1944 | Essl | 123/90.5 |
| 3,108,580 | 10/1963 | Crane | 123/90.5 |
| 3,795,229 | 3/1974 | Weber | 74/569 |

*Primary Examiner*—Charles J. Myhre
*Assistant Examiner*—Daniel J. O'Connor
*Attorney, Agent, or Firm*—Price, Heneveld, Huizenga & Cooper

[57] ABSTRACT

One end of the hollow valve lifter body is bifurcated forming two spaced supports. A roller is rotatably supported between the supports by a shaft and the circumferential edge rotates in a recess in the body end formed by plunge milling the wall portions of the body intermediate the support and providing a counterbore at the bifurcated end. Preferably, the counterbore is formed simultaneously with the fabrication of the body.

7 Claims, 7 Drawing Figures

ROLLER TAPPET

BACKGROUND OF THE INVENTION

Roller tappets have known advantages in certain situations since they allow increased lift velocity without increasing the body diameter. Other known advantages are increased engine breathing and durability. Conventional roller tappets comprise a central valve lifter body portion with a bifurcated end in which the roller is mounted above the central body portion. This configuration requires a lengthier tappet compared to other types of similar diameters and hence forecloses their use in many situations.

It has been suggested previously to make a more compacted roller tappet but applicant is unaware of any actual prior art examples which were developed or utilized commerically. One reason for this is attributed to the minimum longitudinal guide surface requirement in many tappets. The lifter body reciprocates in an opening in the engine block and sufficient guide surface areas are required. These guides are particularly critical in a spool-type lifter which utilizes an external recess. Referring to FIG. 1, a pair of spool-type prior art roller tappets *a* positioned in a portion of an internal combustion engine having a cylinder block *b* in cylindrical bores *c* in which the valve lifters *a* reciprocate. Each lifter *a* comprises a body *d*, the body having a lower bifurcated end *e* in which a roller *f* is rotatably mounted by a shaft. A cam shaft *j* is rotatably mounted in the engine and has cam lobes *k* which engages each roller to reciprocate the valve lifters which in turn engage pushrods *l* in a conventional manner. The valve lifter bodies *d* are spool-like and utilize a one-piece valve lifter guide or retaining clip *m* which is not discussed in detail. The operation of this particular type of roller tappet is set forth in U.S. Pat. No. 3,795,229. However, a recess *n* is required thereby limiting the length of guide annulus *o*. Thus the rollers *f* extend completely beyond the lower end of the tappets. In such or similar situations, it has not been possible heretofore to foreshorten the overall length of the roller tappet. Any attempt to recess the roller portion into the central body portion was at the expense of the guide surface *o* which was not acceptable. It might seem that reduction could be achieved by simply plunge milling the end of the lifter body intermediate the roller supports. However this cannot be achieved since the supports interfere with the axle of the plunge milling apparatus. While it might be possible to utilize more sophisticated milling procedures, the expense of such procedures prohibited any commercial development of such a tappet heretofore. Thus, there is a need in this art for an improved roller tappet assembly.

SUMMARY OF THE INVENTION

In accordance with the invention, at least one end of the lifter body is hollow and bifurcated to form spaced supports. The hollow end defines a skirt-like guide portion at the transition of the supports and a roller is rotatably mounted between the supports by a shaft. The roller extends below the supports into the hollow end of the body in a recess formed by an inwardly machined surface of curvature along the body wall intermediate the supports. In addition a counterbore is provided at the base of the supports to permit clearance for the roller in combination with the curved surfaces without decreasing the guide surface area. The curved surface is preferably plunge milled which is economically attractive while the counterbore permits clearance at the critical locus. While clearance could be provided by end milling, this process is too expensive and although plunge milling is acceptable costwise, complete clearance cannot be obtained without reducing the guide surface below acceptable minimums. The combination of plunge milling and counterboring thus is the preferred configuration.

The subject invention permits production of a commerically acceptable roller tappet wherein the roller is tucked or recessed into the end of the lifter body which has heretofore not been successfully done. It permits fabrication of a foreshortened roller tappet of a given diameter relative any other known roller tappet of similar diameter. The present invention thus makes available, the utilization of a roller tappet and its particular advantages in a given engine requiring a given diameter and length lifter not heretofore possible. In addition, it permits such capability within competitive economic production costs. The lifter body is formed with a counterbore and simply plunge milled the required amount to provide the combined clearance. Other advantages of the invention will become apparent to those skilled in the art from the following description and accompanying drawings.

DESCRIPTION OF THE PREFERRED EMBODIMENT

Figure 3:
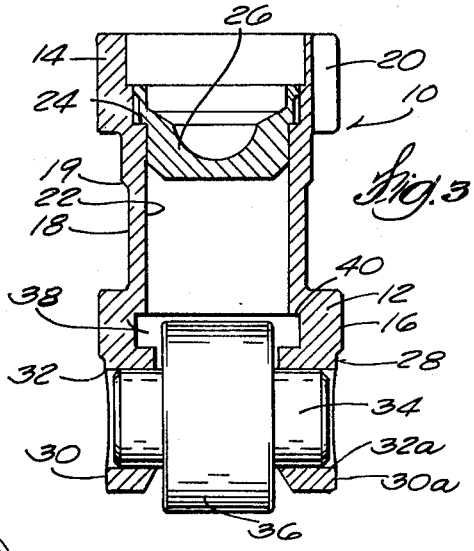
FIG. 3 is a cross sectional view of the tappet illustrated in FIG. 2 taken generally along line III—III in FIG. 2.
Figure 2:
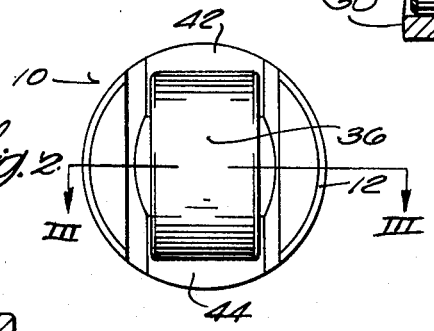
FIG. 2 is a top plan view of the roller tappet of the invention.

Referring now in detail to the drawings, and particularly, FIGS. 2 and 3, the assembled roller tappet 10 of the invention is illustrated. A hollow spool-like lifter body 12 includes an upper annulus portion 14 and a lower annulus portion 16 spaced by a recess 18. The annulus portions 14 and 16 are skirt-like and function as guides for the lifter body as it reciprocates in the cylindrical bore of the cylinder block of an internal combustion engine. The lifter body wall thickness at recess 18 is offset at 19 and is adapted to receive a retaining clip (not shown) which cooperates with a slot 20 in a known manner. The internal wall 22 of the lifter body includes a shoulder 24 formed in the upper end for receipt of a pushrod seat member 26.

The lower end 28 is bifurcated forming a pair of spaced supports 30 and 30*a* extending from end 28. Aligned openings 32, 32*a* through the supports receive a shaft 34 on which a roller 36 is rotatably mounted. Roller 36 extends inwardly beyond end 28 into the interior of hollow lifter body. This is achieved by providing a clearance 38 comprised of a counterbore 40

(FIG. 3) and milled surfaces 42, 44 (FIG. 2). The details of this configuration are set forth hereinafter.

Figure 5:
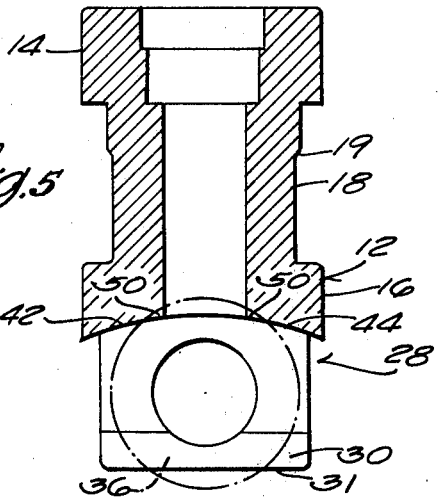
FIG. 5 is a cross sectional view taken along line V—V from FIG. 4.
Figure 4:
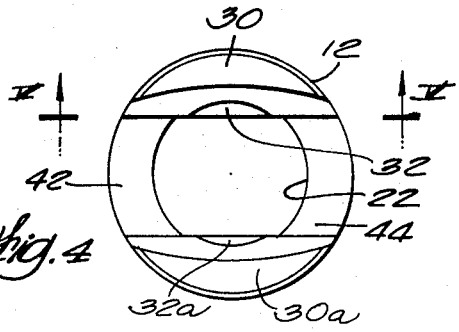
FIG. 4 is an end view of the lifter body without the counterbore.

Referring to FIGS. 4 and 5, body 12 is illustrated without counterbore 40. The contour of plunge milled surfaces 42 and 44 however are illustrated. It should be appreciated, that the depth or longitudinal distance of surfaces 42 and 44 from the terminal end 31 of support 30 is the maximum permitted before end 31 will physically interfere with the shaft of the mill (not shown). The conventional mill, of course, utilizes a circular mill tool rotated about an axis and the surfaces 42 and 44 reflect a specific radius of curvature.

Figure 1:
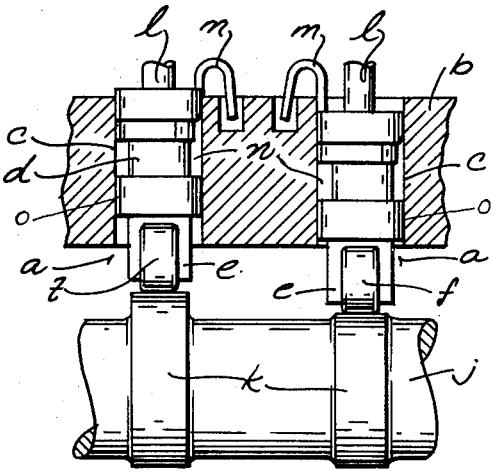
Fig. 1 PRIOR ART
FIG. 1 is a sectional view of a pair of prior art valve lifters and attendant guides operatively mounted in an internal combustion engine.

The longitudinal length of guide 16 is illustrated at its minimum desired distance and further milling or other type of deformation of the inclined surfaces 42 and 44 which would foreshorten the longitudinal length of guide 16 past that illustrated in FIG. 5 has been found to be undesirable in the operation of the valve lifter. It is noted however that the milled surfaces 42 and 44 each define a locus of interference 50 which prevents placement of roller 36 illustrated in phantom in FIG. 5. An alternative to plunge milling would be to end mill a surface which would permit such clearance but this has been found to be at an unacceptable economic cost. Thus, plunge milling itself has been found inadequate to provide proper clearance while maintaining the critical guide lengths required for acceptable operation of the valve lifter. It should be appreciated that the particular embodiment illustrated is particularly designed for utilization with a one-piece valve lifter retaining clip *m* as illustrated in the prior art (FIG. 1) and this clip requires the particular recess configuration 18 with offset 19 and slot 20 (FIG. 3) for operation. Thus, the longitudinal length of guide skirts 14 and 16 are physically limited by the configuration and operation of the particular lifter illustrated.

Figure 7:
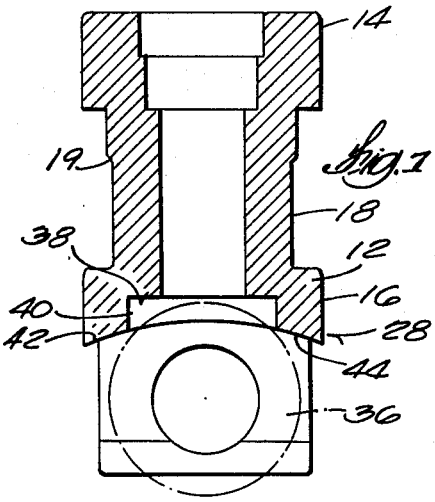
FIG. 7 is a cross sectional view of the lifter body taken along line VII—VII from FIG. 6.
Figure 6:
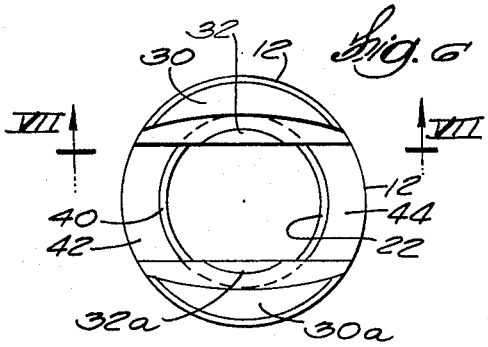
FIG. 6 is an end view of the valve lifter body in accordance with the invention.

Referring now to FIGS. 6 and 7, the lifter body as illustrated in FIG. 5 is shown in its completed configuration with a counterbore 40 formed internally in the bifurcated end 28. As can be readily ascertained, the counterbore eliminates the locus of interference 50 illustrated in FIG. 5. The combination of counterbore 40 and milled surfaces 42, 44 thus provide a complete clearance 38 for roller 36 likewise illustrated in phantom in FIG. 7. The resultant roller tappet is considerably more compact in the longitudinal dimension than any heretofore known since previously, it was required that the roller rotates free completely external from the bifurcated end point.

Although but one embodiment has been shown and described in detail, it will be obvious to those having ordinary skill in this art that the details of construction of this particular embodiment may be modified in a great many ways without departing from the unique concepts presented. It is therefore intended that the invention is limited only by the scope of the appended claims rather than by particular details of construction shown, except as specifically stated in the claims.

The embodiments of the invention in which an exclusive property or privilege is claimed are defined as follows:

1. A roller tappet comprising, a tubular body having an open end, a pair of spaced supports extending from said open end, said open end including means defining a clearance recess, and a roller rotatably mounted intermediate said supports by a shaft extending through said supports, the periphery of said roller extending internally into said hollow body in said clearance recess, said clearance recess comprising a surface of curvature formed inwardly from the exterior wall of said body to the interior wall on the interior of each spaced support said surfaces of curvature having a radius of curvature formed by plunge milling, said surfaces being inadequate by themselves to permit clearance of said roller, and means defining a counterbore in said open end extending internally from said surfaces of curvature, said surfaces of curvature and said counterbore providing clearance for said roller from said body.

2. The combination according to claim 1 wherein said body is spool-like having a skirt-like guide annulus at each end spaced by a single external recess.

3. A roller tappet comprising in combination: a one-piece valve lifter body having at least a hollow end portion defining an outer wall portion and inner wall portion, spaced supports extending from said one end, and a roller rotatably mounted on a shaft positioned through said supports, said roller being positioned intermediate said supports, the circumferential edge of said roller extending partially within said one end and means defining a clearance in said end between said roller and said lifter body whereby said roller is partially recessed within said lifter body, said clearance comprising plunge milled surfaces of curvature intermediate said spaced supports with a radius of curvature extending inwardly from said outer wall portion to said inner wall portion of each spaced support, and a counterbore extending inwardly from said surfaces, said plunge milled surfaces being incapable of providing sufficient clearance for said roller independently of said counterbore but together therewith providing sufficient clearance between said roller and body.

4. The combination according to claim 3 wherein said milled surface is slanted inwardly from the end plane of said one end upwardly to the interior of said lifter body.

5. The combination according to claim 4 wherein said body includes an annular guide skirt on each end and a single midsection of reduced diameter adapted for receipt of a retaining clip.

6. A roller tappet comprising, in combination, a valve lifter body having at least a hollow end portion, a counterbore in said end portion, spaced supports extending from said end portion, surfaces on said end portion intermediate said supports, said surfaces being plunge milled and curved inwardly from said end to the interior wall thereof and connecting with said counterbore, and a roller rotatably mounted between said spaced supports and extending into the interior of said end in the clearance formed by said counterbore and surfaces.

7. The combination according to claim 6 wherein said body includes annular guide surfaces externally on each end of said body spaced by a single recess adapted to receive a retaining clip.

* * * * *